US008403695B2

(12) United States Patent
Wang et al.

(10) Patent No.: US 8,403,695 B2
(45) Date of Patent: Mar. 26, 2013

(54) PLUG CONNECTOR HAVING IMPROVED RELEASING MECHANISM AND A CONNECTOR ASSEMBLY HAVING THE SAME

(75) Inventors: Chien-Chiung Wang, New Taipei (TW); Qing-Man Zhu, Kunshan (CN); Peng Zhai, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 48 days.

(21) Appl. No.: 13/190,503

(22) Filed: Jul. 26, 2011

(65) Prior Publication Data

US 2012/0021627 A1 Jan. 26, 2012

(30) Foreign Application Priority Data

Jul. 26, 2010 (CN) ..... 2010 2 0270657

(51) Int. Cl.
*H01R 13/627* (2006.01)

(52) U.S. Cl. ..... 439/352; 385/92

(58) Field of Classification Search ..... 439/352, 439/353, 357, 358; 385/88, 89, 92, 93, 94; 361/728, 754
See application file for complete search history.

(56) References Cited

U.S. PATENT DOCUMENTS

| | | | | |
|---|---|---|---|---|
| 6,430,053 | B1 * | 8/2002 | Peterson et al. | 361/728 |
| 6,655,979 | B1 * | 12/2003 | Lee | 439/357 |
| 6,746,158 | B2 | 6/2004 | Merrick | |
| 6,749,448 | B2 | 6/2004 | Bright et al. | |
| 6,786,653 | B1 * | 9/2004 | Hwang et al. | 385/92 |
| 6,816,376 | B2 * | 11/2004 | Bright et al. | 361/704 |
| 6,881,095 | B2 * | 4/2005 | Murr et al. | 439/607.2 |
| 6,885,560 | B2 * | 4/2005 | Zaremba | 361/754 |
| 6,916,196 | B2 * | 7/2005 | Long et al. | 439/352 |
| 7,147,502 | B1 * | 12/2006 | Wu | 439/352 |
| 7,204,712 | B2 * | 4/2007 | Schwiebert et al. | 439/352 |
| 7,534,125 | B1 * | 5/2009 | Schroll | 439/352 |
| 7,824,208 | B2 * | 11/2010 | Crofoot et al. | 439/352 |

* cited by examiner

*Primary Examiner* — Thanh Tam Le
(74) *Attorney, Agent, or Firm* — Wei Te Chung; Ming Chieh Chang

(57) ABSTRACT

A connector assembly (100) includes a receptacle (2) having an inwardly extending latching tab (21), and a plug connector (1) insertable into the receptacle. The plug connector includes a housing (12) defining opposite first and second sides and a pair of grooves (123), and a releasing mechanism (11) including an outwardly tilting releasing tab (110) located at the first side, a lever (114) located at the second side, and a body portion (116) formed with a pair of inverted U-shaped resilient portions (115) received in the grooves. The releasing tab is movable rearwardly, by a rearward movement of the lever through a deformation of the resilient portions, to outwardly push the latching tab for permitting an extraction of the housing.

10 Claims, 5 Drawing Sheets

PLUG CONNECTOR HAVING IMPROVED RELEASING MECHANISM AND A CONNECTOR ASSEMBLY HAVING THE SAME

BACKGROUND OF THE INVENTION

1. Field of the Invention

The present invention relates to a plug connector and a connector assembly, and more particularly to a SFP (Small Form-Factor Pluggable) plug connector adapted for inserting into and extracted from a receptacle, and a connector assembly including the plug connector and the receptacle.

2. Description of Related Art

U.S. Pat. No. 6,749,448 issued to Bright et al. on Jun. 15, 2004 discloses an SFP plug adapted for inserting into a receptacle having a latching tab. The SFP plug comprises a releasing mechanism having a pair of substantially parallel actuator arms extending longitudinally along a respective one of opposite side walls of the receptacle. Each of the arms comprises a sidewardly extending releasing tab. When the plug is inserted into the receptacle, the latching tab resists against the side wall of the actuator arm. When the plug is extracted from the receptacle, the releasing tab outwardly depresses the latching tab to allow the extraction of the plug connector. Each arm defines a channel and has a coiled spring received in the channel for providing restoring force to the releasing mechanism.

It is complicated to form the channel on the arm and receive the coiled spring in the channel.

Hence, a plug connector having an improved releasing mechanism and a connector having the same is desired.

SUMMARY OF THE INVENTION

Accordingly, an object of the present invention is to provide a plug connector having a releasing mechanism having simple configuration and capable of saving cost, and a connector assembly including the same.

In order to achieve the object set forth, a connector assembly in accordance with the present invention includes a receptacle having an inwardly extending latching tab, and a plug connector insertable into the receptacle. The plug connector includes a housing defining opposite first and second sides and a pair of grooves, and a releasing mechanism including an outwardly tilting releasing tab located at the first side, a lever located at the second side, and a body portion interconnecting the releasing tab and the lever. The body portion is formed with a pair of resilient portions received in the grooves. The releasing tab is movable rearwardly, by a rearward movement of the lever through a deformation of the resilient portions, to outwardly push the latching tab for permitting an extraction of the housing.

The releasing mechanism is assembled to the housing and obtain resilient force via the resilient portions, which are punched from a excessive material of the releasing mechanism. It is easy to manufacture and the manufacture cost could be reduced.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
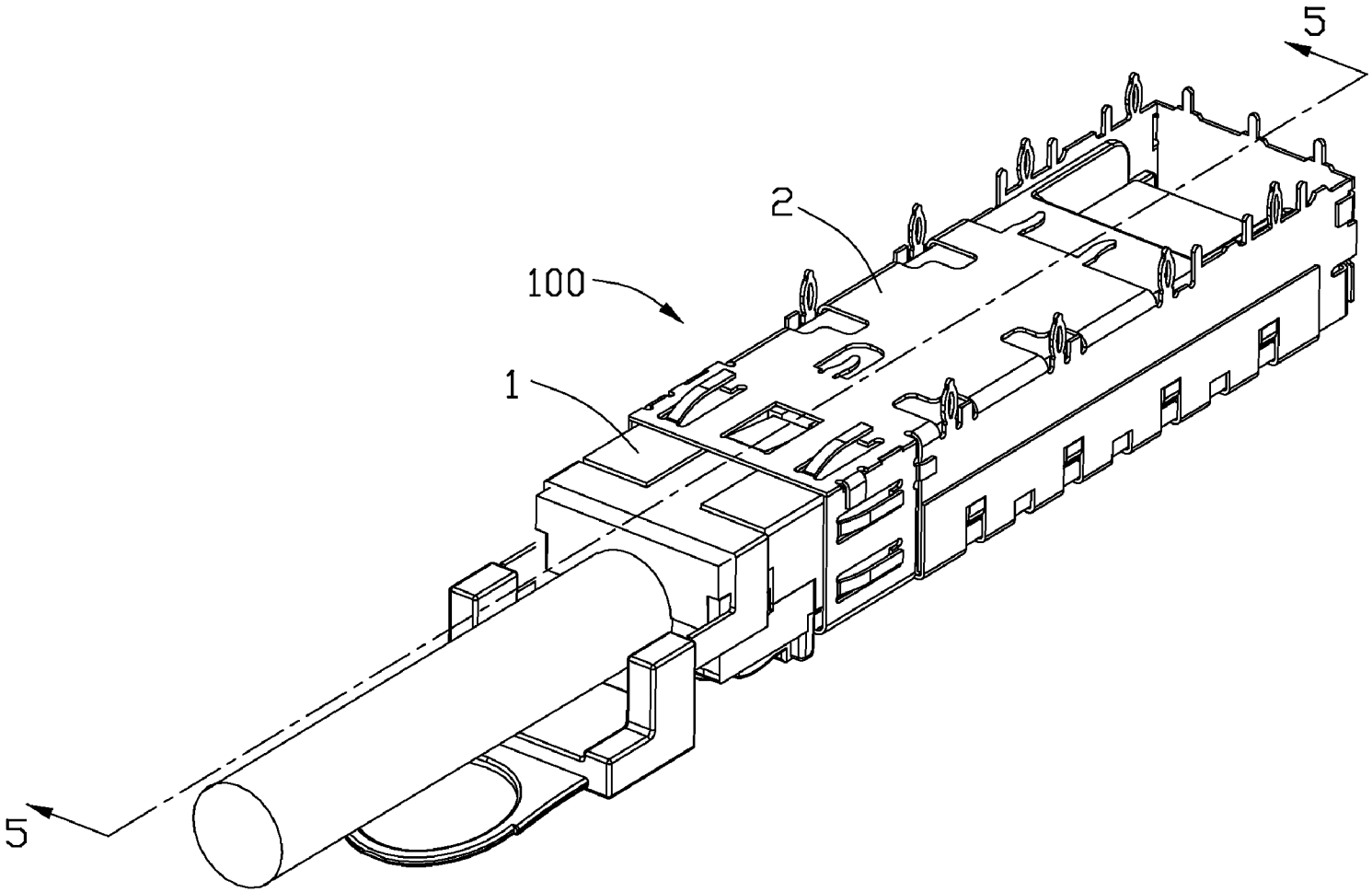
FIG. 1 is an assembled perspective view showing a connector assembly in accordance with the present invention.
Figure 2:
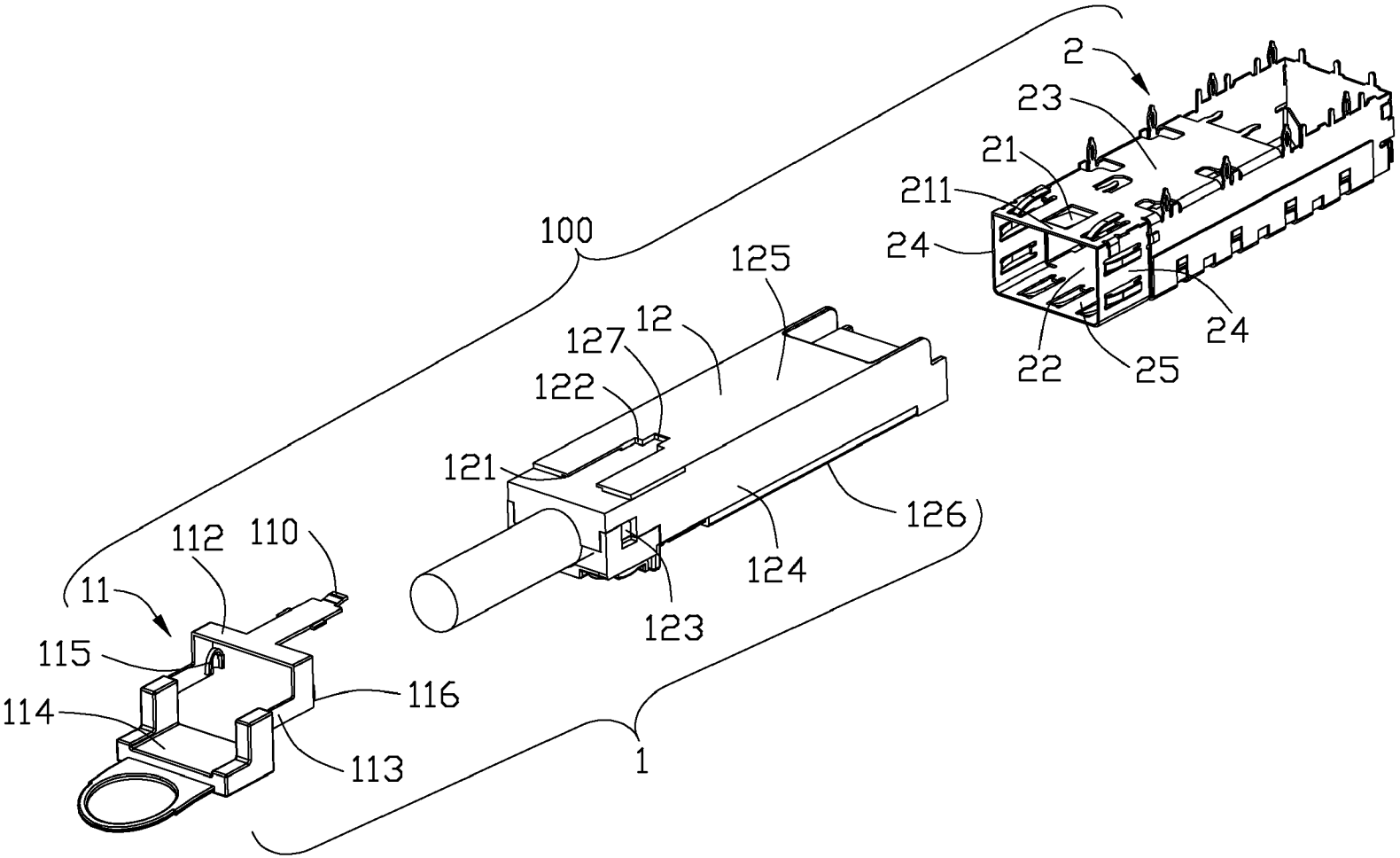
FIG. 2 is an exploded perspective view showing the connector assembly as shown in FIG. 1.
Figure 3:
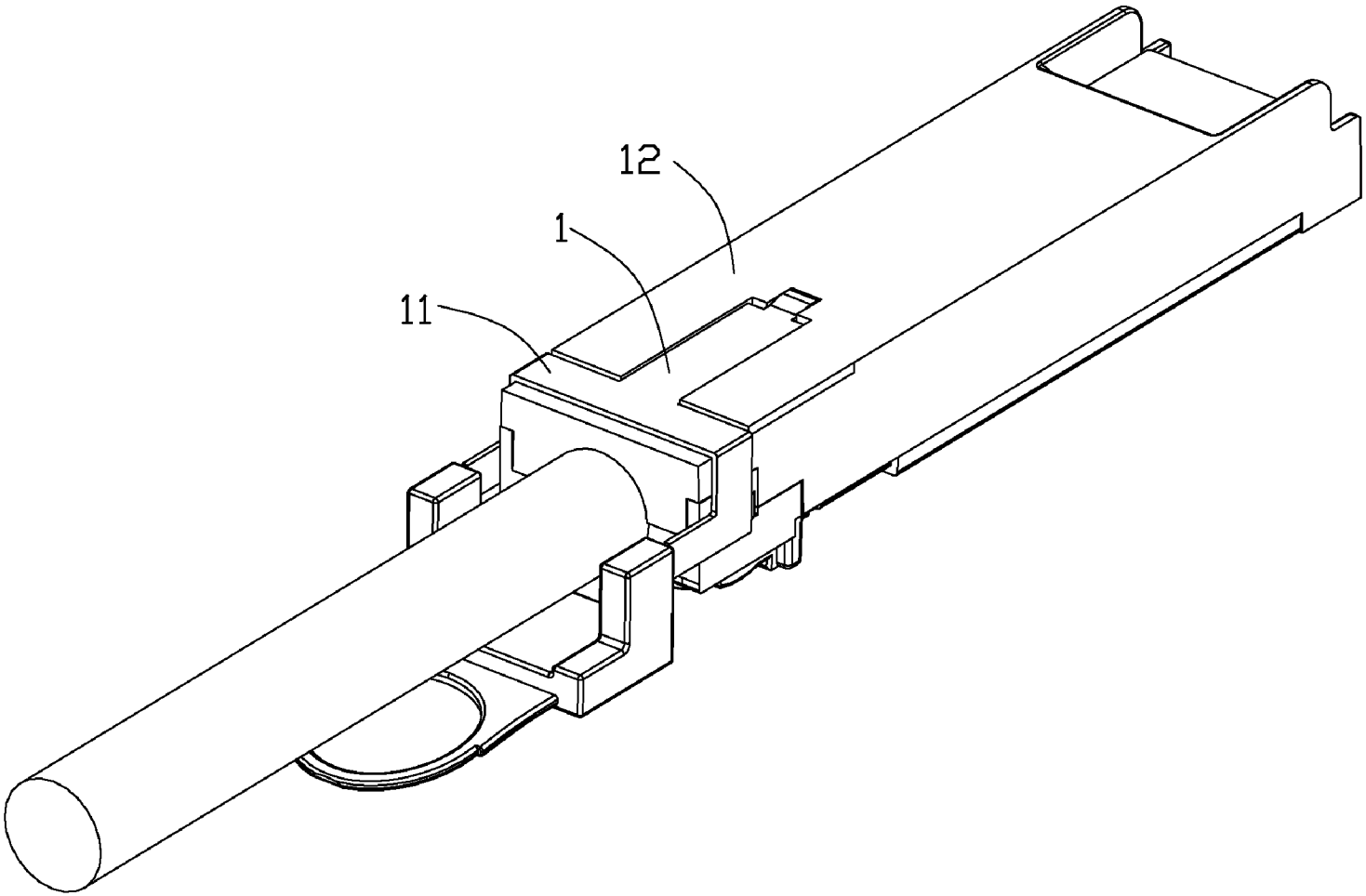
FIG. 3 is an assembled perspective view showing a plug connector.

Referring to FIGS. 1-2, a connector assembly 100 comprises a receptacle 2, a plug connector 1 received in the receptacle 2.

The receptacle 2 comprises a top wall 25, a bottom wall 23, a pair of side walls 24, and a receiving cavity 22 defined therebetween. The bottom wall 23 includes a latching tab 21 having a connecting edge 211 adjacent to the uninserted plug connector 1 and connected with the bottom wall 23, and a free edge 212 (FIG. 5) extending downwardly toward the receiving cavity 22.

Referring to FIG. 2, the plug connector 1 comprises a housing 12 and a releasing mechanism 11 assembled to the housing 12. The housing 12 comprises an upper face 125, a lower face 126 opposite to the upper face 125, and a pair of periphery faces 124 each defining a groove 123. The upper face 125 of the housing 12 defines an indentation 127 and an elongated slot 121 extending along a front-to-back direction. The indentation 127 has a width smaller than that of the elongated slot 121 to thereby form a shoulder portion 122 between the elongated slot 121 and the indention 127.

Figure 4:
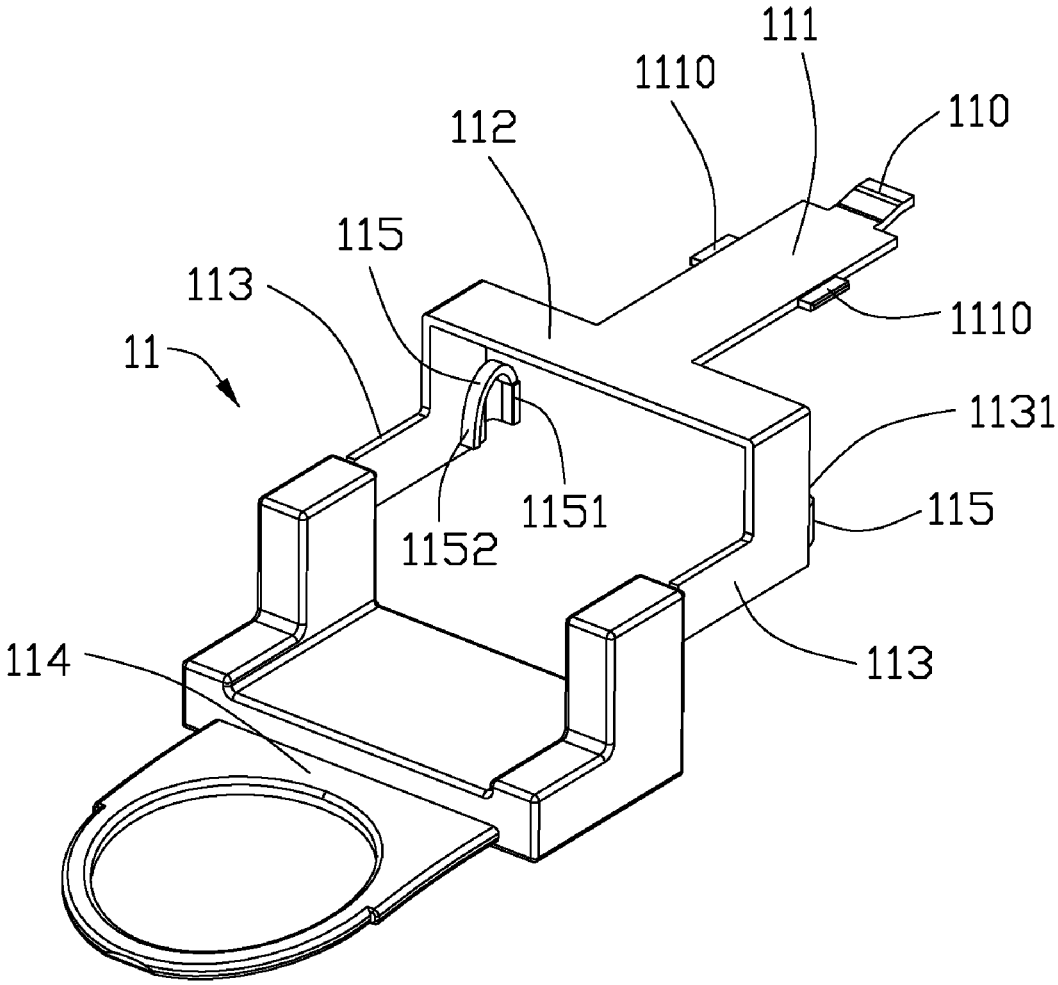
FIG. 4 is perspective view showing a releasing mechanism.

Referring to FIGS. 2 and 4, the releasing mechanism 11 comprises an upwardly tilting releasing tab 110, a lever 114, a pair of resilient portions 115 between the releasing tab 110 and the lever 114, and a body portion 116 interconnecting the releasing tab 110, the lever 114 and the resilient portions 115 into a single piece.

The body portion 116, preferably stamped and formed from a sheet of metal, comprises a forwardly extending beam portion 111, a bride portion 112 connecting with the beam portion 111 and extending along a transverse direction perpendicular to the front-to-back direction, and a pair of connecting portions 113 extending downwardly then rearwardly from opposite ends of the bridge portion 112. The releasing tab 110 is formed at a front end of the beam portion 111. The beam portion 111 further has a pair of ear portions 1110 projecting oppositely along the transverse direction. The pair of connecting portions 113 respectively have a pair of side edges 1131. Each of the resilient portions 115 is punched from a material connected with the side edge 1131 of the connecting portion 113, and has a first end 1151 connecting with the corresponding side edge 1131 and a second flexible free end 1152 rearward the first end 1151. The lever 114 extends rearwardly from the pair of connecting portions 113.

Referring to FIGS. 1-4, in assembling of the plug connector 1, the releasing mechanism 11 is assembled to the housing 12 by mounting the pair of resilient portions 115 in the grooves 123, with the beam portion 111 received in the elongated slot 121, the releasing tab 110 disposed in the indentation 127, and the lever 114 disposed below the housing 12. The beam portion 111 is confined in the front-to-back movement in the elongated slot 121 in virtue of the pair of ear portions 1110.

Figure 5:
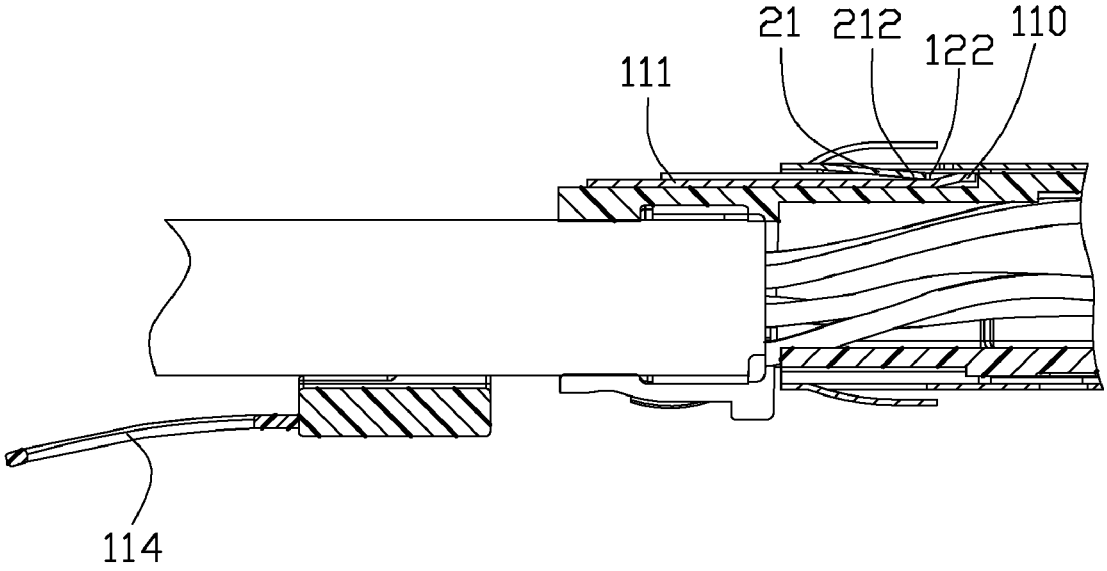
FIG. 5 is a cross-sectional view of the connector assembly, taken along line 5-5 of FIG. 1.

In conjunction with FIG. 5, when the plug connector 1 is inserted into the receiving cavity 22 of the receptacle 2, the releasing tab 110 slides across the latching tab 21 and is positioned forwardly of the latching tab 21. The latching tab 21 resists against the shoulder portion 122 of the plug connector 1 for latching the plug connector 1 in the receptacle 2.

In extraction of the plug connector 1 from the receiving cavity 22 of the receptacle 2, when the lever 114 is pulled rearwardly, the releasing tab 110 moves rearwardly to upwardly push the latching tab 21 for permitting an extraction of the housing 12, with the pair of resilient portions 115 compressible rearwardly in the grooves 123.

The releasing tab 110 and the lever 114 could be assembled to the upper side and lower side of the housing 12, and could also be assembled to opposite periphery sides of the housing 12. Optionally, the releasing tab 110 is not limited to be formed at the front end of the beam portion 111.

The releasing mechanism 11 is assembled to the housing 12 and obtain resilient force via the resilient portions 115, which are punched from a excessive material of the releasing mechanism 11. The releasing tab 110, the lever 114 and the resilient portions 115 are made into a single piece. It is easy to manufacture the plug connector 1 and the manufacture cost could be reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector adapted for inserting into a receptacle having an inwardly extending latching tab, comprising:

a housing defining a first side, a second side opposite to the first side and a pair of grooves between the first side and the second side; and a releasing mechanism assembled to the housing and comprising an outwardly tilting releasing tab located at the first side of the housing, a lever located at the second side of the housing, and a body portion interconnecting the releasing tab and the lever, said body portion being formed with a pair of inverted U-shaped resilient portions received in the grooves of the housing, the releasing tab being moveable rearwardly, by a rearward movement of the lever through a deformation of the resilient portions, to outwardly push the latching tab for permitting an extraction of the housing;

wherein said housing comprises an upper face at the first side, a lower face at the second side, and a pair of periphery faces, said pair of grooves being respectively defined on the periphery faces;

wherein said upper face of the housing defines an elongated slot and an indentation receiving said releasing tab, said indentation having a width smaller than that of the elongated slot to thereby form a shoulder portion between the elongated slot and the indention for being resisted against by said latching tab of the receptacle;

wherein said body portion of the releasing mechanism comprises a forwardly extending beam portion received in the elongated slot, said releasing tab being formed at a front end of the beam portion; and wherein said body portion of the releasing mechanism comprises a bride portion connecting with the beam portion and extending along a transverse direction, a pair of connecting portions extending downwardly then rearwardly from opposite ends of the bridge portion, each of said resilient portions being formed at an inner side of the connecting portion.

2. The plug connector as claimed in claim 1, wherein said body portion of the releasing mechanism has a pair of side edges, each resilient portion being punched from a material connected with the side edge of the body portion, each resilient portion having a first end connecting with the corresponding side edge and a second flexible free end.

3. The plug connector as claimed in claim 1, wherein said beam portion is formed with a pair of ear portions, the beam portion being confined in a front-to-back movement within the elongated slot in virtue of the pair of ear portions.

4. The plug connector as claimed in claim 1, wherein said releasing tab, said lever and said body portion are formed into a single piece.

5. A connector assembly comprising:

a receptacle having an inwardly extending latching tab; and a plug connector comprising:

a housing defining opposite first and second sides, and a pair of grooves;

a releasing mechanism assembled to the housing and comprising an outwardly tilting releasing tab located at the first side of the housing, a lever located at the second side of the housing, and a body portion interconnecting the releasing tab and the lever, said body portion being formed with a pair of inverted U-shaped resilient portions received in the grooves of the housing, the releasing tab being movable rearwardly, by a rearward movement of the lever through a deformation of the resilient portions, to outwardly push the latching tab for permitting an extraction of the housing;

wherein said body portion of the releasing mechanism having a pair of side edges, each resilient portion being punched from a material connected with the side edge of the body portion, each resilient portion having a first end connecting with the corresponding side edge and a second flexible free end;

wherein said housing comprises an upper face at the first side, a lower face at the second side, and a pair of periphery faces, said grooves being respectively defined on the periphery faces; and wherein said upper face of the housing defines an elongated slot, an indentation receiving said releasing tab, said indentation having a width smaller than that of the elongated slot to thereby form a shoulder portion between the elongated slot and the indention for being resisted against by said latching tab of the receptacle.

6. The connector assembly as claimed in claim 5, wherein said releasing tab, said lever and said body portion are formed into a single piece.

7. An electrical connector assembly comprising:

a receptacle cage defining a receiving cavity defining a board mount side and an opposite locking side with thereon a latch tab extending inwardly into the receiving cavity;

a plug connector including:

a housing adapted to be inserted into the receiving cavity along a front-to-back direction and defining opposite first and second faces wherein the first face intimately confronts the mounting side and the second face intimately confronts the locking side when the plug is received in the receptacle cage;

a releasing mechanism assembled to the housing and including an insulative part and a metallic part integrally formed with each other, said insulative part defining a lever located around the first face and the metallic part defining a releasing tab located around the second face to lock to the latch tab when the plug is received in the receptacle cage;

wherein said metallic part further unitarily forms a resilient portion to provide restoration force so as to help the releasing mechanism move forward once the releasing mechanism is rearwardly moved to outwardly deform the latch tab for releasing the plug connector from the receptacle cage;

wherein said resilient portion is located on two sides of the housing between the first and second faces in a vertical direction perpendicular to said front-to-back direction; and wherein the insulative part defines a U-shaped configuration in the vertical direction, and the metallic part defines another U-shaped configuration in the vertical direction opposite to said U-shaped configuration.

8. The electrical connector assembly as claimed in claim 7, wherein the insulative part is essentially fully exposed outside of the housing in an axial direction of a cable connected to a rear end of the housing.

9. The electrical connector assembly as claimed in claim 7, wherein the metallic part is essentially mounted upon the housing.

10. The electrical connector assembly as claimed in claim 7, wherein a cable is connected to a rear end of the housing under condition that the insulative part supports the cable while the metallic part does not.

* * * * *